United States Patent [19]

Berner

[11] 3,960,196

[45] June 1, 1976

[54] DOOR CLOSURE

[76] Inventor: Erling Berner, Loretohohe 5, CH-6300, Zug, Switzerland

[22] Filed: May 13, 1974

[21] Appl. No.: 469,229

Related U.S. Application Data

[60] Division of Ser. No. 339,774, March 14, 1973, Continuation-in-part of Ser. No. 241,925, April 7, 1972, Pat. No. 3,886,851.

[52] U.S. Cl. ..... 160/222; 160/202

[51] Int. Cl.[2] ..... E06B 3/12; E06B 9/00

[58] Field of Search ..... 160/193, 197, 202, 222

[56] References Cited

UNITED STATES PATENTS

| | | | |
|---|---|---|---|
| 888,433 | 5/1908 | Thompson | 160/202 |
| 1,927,982 | 9/1933 | Howard | 160/202 |
| 2,007,552 | 7/1935 | Vetterlein | 160/202 |
| 2,057,850 | 10/1936 | Sims | 160/202 |
| 3,430,676 | 3/1969 | Aberg | 160/202 |
| 3,698,465 | 10/1972 | Aberg | 160/222 |

*Primary Examiner*—Paul R. Gilliam
*Assistant Examiner*—Carl F. Pietruszka

[57] ABSTRACT

A door closure useful as such, but particularly as an air curtain device and process in which laterally spaced-apart parallel sliding sections of a closure formed of separable or pivotally connected vertically mounted panels form a flexible air duct between inner and outer sections connected to a nozzle supported at a bottom outlet between the sections to provide an air screen of homogeneity and resistance to lateral air currents in various open, partially open and closed door positions, by air passed into the top between the sections, from a plenum passing air received from a fixed blower mounted above or near the top of the door within a space enclosed by the walls of the opening.

9 Claims, 16 Drawing Figures

DOOR CLOSURE

This invention is a division of co-pending application Ser. No. 339,774 (BNR 315), filed Mar. 14, 1973, is a continuation-in-part of my copending application, Ser. No. 241,925, filed Apr. 7, 1972 now Pat. No. 3,886,851, issued June 3, 1975, and relates to an air curtain device including a blower mounted within or adjacent to a wall opening, and having a movable closure, such as a sliding or movable double door having spaced-apart inner and outer sections, the center space portion of said door forming a duct for air passage communicating at one end through an intermediate plenum with said blower and emitting the air through a nozzle in an air screen from the other end of said door.

More particularly, the invention is directed to a sliding door including several improved features such as insulation and end sealing means and to a process of establishing and using an air curtain cooperatively with said door for optimum protection of an open or partially open door position and to improved use of such air curtain device to provide lateral flow, and to several structural and process improvements disclosed in my parent application. The present application includes claims to the door closure device.

The inner and outer sections of the door hereof. In a primary aspect of this invention, are an assembly of numerous panels separably or pivotally joined at their edges to be relatively movable, one panel with respect to the next contiguous panel. The assembled panels of both inner and outer sections may be moved, usually vertically, and slide one upon the next between guides at each end, sealing both inner and outer sections to the wall opening at opposite ends of the panels. The panels thus form a double door, either or both sections of which may be raised and lowered from an upper, preferably nested, position of the panels in open or partially open door position to an extended edge to edge sealed position of the panels when the door is closed. The spaced-apart inner and outer sections of the double door maintain between them a continuously sealed air passage for flow of air from a variably sized plenum communicating with a blower mounted as desired near the upper wall opening, so that the air passes downward through the double door walls to the opposite lower edge of said door where the air is emitted, usually through a nozzle, forming an air screen flowing from the lower end of the partially or fully opened door.

The door is formed of two vertical tiers of separate sliding panels forming both inner and outer sections, the panels being raised and lowered, preferably vertically. The panels at each panel height level are each progressively offset inwardly in the direction of the door closing so that each panel slides upwardly beside the next vertical panel and both inner and outer panels nest in an upper plenum section telescopically as the door is opened.

The inner and outer panels at the same section height may be fastened together, preferably by straps, so that both move vertically in opening and closing of the door as a pair; and a lower pair of panels will nest within the next vertical pair of panels telescopically as the door is opened.

Each panel has bent over flanges sealing an upper panel to a lower one for firm gripping and sealing engagement of a lower panel with an upper, both for sealing the panels against substantial escape of air laterally in sealed position as well as reenforcement of the pair of upper and lower panels, one by the other, against vibration or movement under lateral pressure of wind or weather conditions.

The bottom, the lowermost pair of panels, form or are fitted with a nozzle and which forms an outlet which may be vertically or pivotally mounted between the inner and outer sections of the door to direct an air curtain either vertically downward or at selected angular position therefrom. The upper part of the door includes means for raising and lowering both inner and outer sections; and preferably includes means for raising them in aligned telescopic or nesting position of the panels while allowing a central opening between the inner and outer sections of the door for continuous passage of air from the blower to the nozzle without obstruction or lateral leakage when the panels are vertically sealed in any fully or partially opened position of the door.

Other aspects of the invention includes the mounting of insulation against each panel. Thus each panel board may include an insulated sheet, providing both heat as well as sound insulation. For instance, such insulation will prevent moisture condensation by heat exchange with a colder outer wall as well as sound deadening, thus greatly improving the practical use of the telescopically constructed door.

In other aspects the air is provided by a tangential fan which supplies an even flow of air through the center of the door sections.

In a further aspect the panels are each formed of the same dimension, so that a door may be constructed of a standard strip, cutting the same into panels of the desired length to provide the door, thus allowing ready replacement of a damaged panel with a new panel cut from the stock strip to the desired dimension. It is useful in folding the edges, to form the upper edge of the panel of a slightly larger size then the corresponding oppositely-bent edge of the lower edge of the panel thus to more securely engage the panels into a series for forming the door.

Another feature of the invention lies in the fact that as the door is opened an open pair of panels appearing progressively in a series from top to bottom as the door is progressively closed form a plenum which becomes continuously elongated as the door approaches the closed position. The pressure of the air blowing into the plenum is substantially constant despite the variation in length of the plenum as the door opens telescopically whereby, as the door is opened or closed, a constant pressure is emitted from a lower nozzle imparting a constant quality and integrity to the air screen formed by such nozzle. Thus, this door will operate to produce an air screen of constant air flow and pressure in any position of the door fully opened or partially open to any select degree. Moreover, louvre type openings may be provided at the bottom or at various levels to supply a lateral flow from the interior of the door into a space enclosed by said door.

The plenum is preferably designed to have a cross section at least three times that of the nozzle. This gives the air curtain a homogeneity and strength resistance to turbulence or disruption from a side pressure.

The invention is further described with reference to the drawings wherein.

Figure 1:
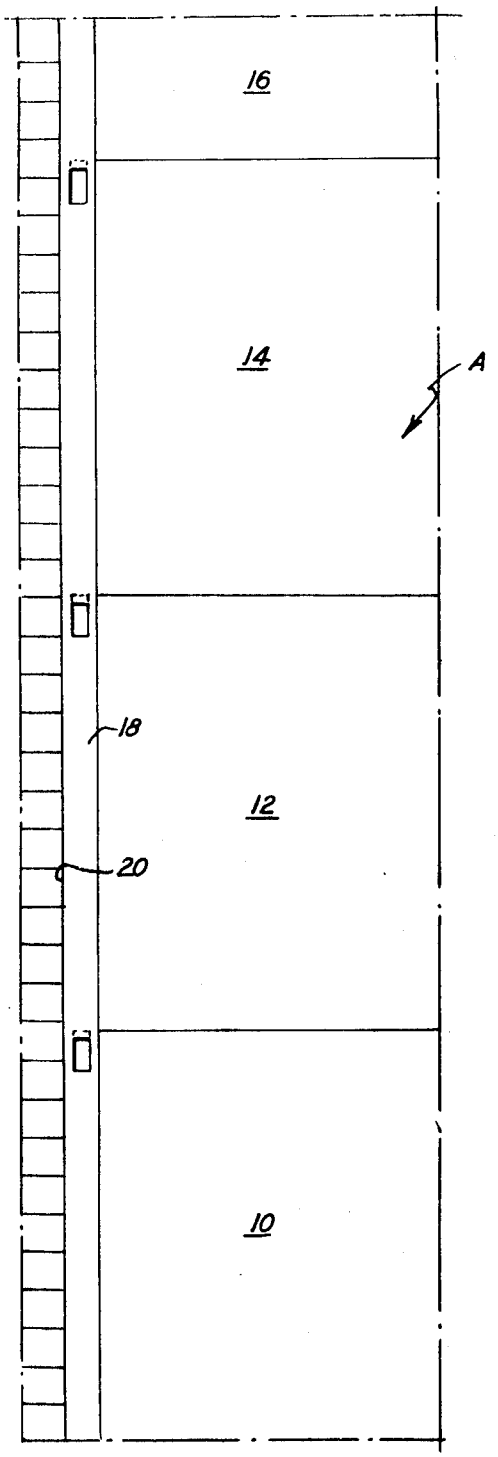
FIG. 1 shows an elevational section of a portion of the edge fastened panels of the door in closed position.

Referring first to FIG. 1, a vertical tier of panels 10, 12, 14 and 16 are arranged with their ends in opposite vertically disposed end guide and sealing members 18 in both sides of a wall opening 20 to slide vertically in both opening and closed direction to form an outer section A of a closure.

Figure 2:
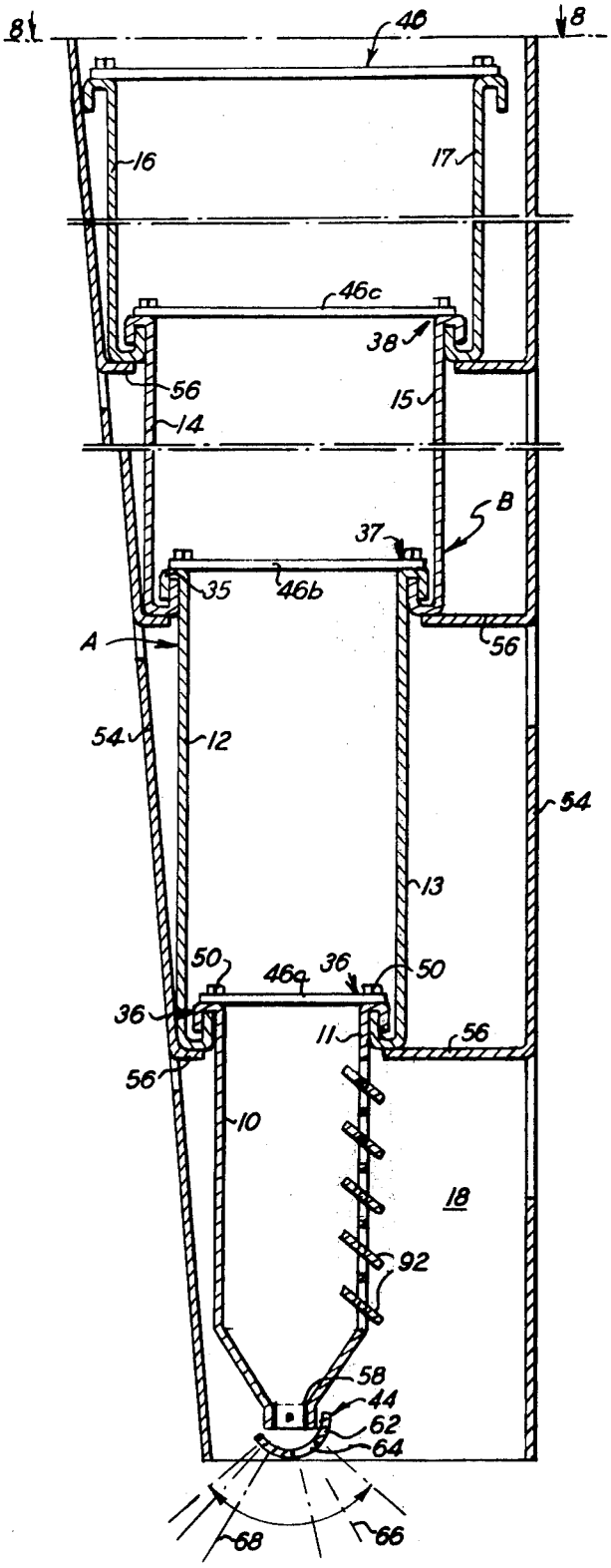
FIG. 2 is an end view in section showing the end sealing of the closure in closed position.

As shown in FIG. 2, there is an assembly of corresponding series of panels 11, 13, 15 and 17 which form the inner side section B of the closure. There may be a variable number, more or less, panels than shown for present purposes of illustration to form the closure, depending upon its size as well as the size of each panel.

Figures 6, 9:
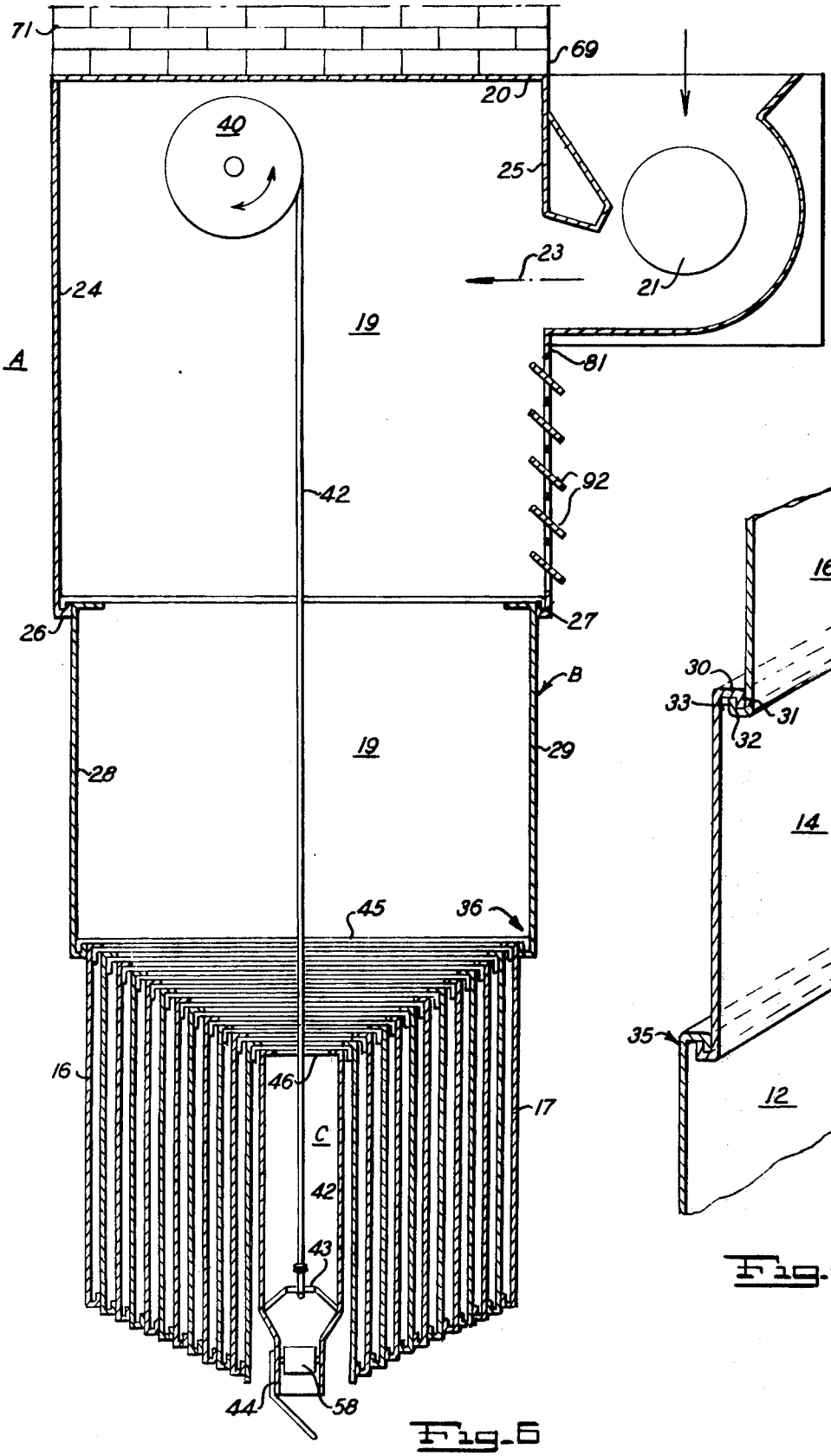
FIG. 6 is a similar sectional end view of the closure in partially open position and using a side blower.
FIG. 9 is a detail showing edge sealing of one panel of the closure to both upper and lower panels.

The panels may be wider or narrower at the top or bottom of the closure to provide economy in the construction or extra strength to the closure in using them wide or narrow at these points as desired. However, as shown in FIG. 9, the panels are preferably each of the same dimensional size so that they may be cut from standard larger sized strips for variously sized doors. In that manner each of the U-bent strips 11–17 are interchangeable and are easily replaced if one or more were damaged or destroyed.

Both sections A and B are spaced apart from each other and may be raised and lowered separately or together in spaced-apart relationship, but preferably are handled together as a single closure, as will appear. Beside and near the top of the opening 20, as shown in FIG. 6, is fixedly mounted a blower 21, preferably a tangential blower such as shown in my prior U.S. Pat. No. 3,362,469. As shown in several figures, a plenum chamber 19 is mounted in the top portion of the wall opening into which the outlet air flow 23 from the blower 21 is discharged. The top of the plenum 19 has fixed sides 24 and 25 whose lower ends 26 and 27 are fastened at opposite upper sides 28 and 29 in any position of the upper, outer and inner closure sections A and B to discharge its air flow as received from the air blower into a space C between the sections.

The several panels in the vertical series comprising each closure section from the bottom to the top, as shown in FIGS. 2, 3, 4, 5 and 6, are disposed progressively outward one to the next in the opening direction and may slide, one panel against the next, in raising and lowering, so that the uppermost panels 28 and 29 encase or house each of the lower panels of each section telescopically. Moreover, as the nested sections expand in closing of the doorway, the plenum 19 continuously expands in the closing direction and is thereby of varied size as the door opening varies from closed through partially open to completely open positions of the door.

As shown in FIG. 9, the top and bottom edges of each intermediate panel are bent to extend laterally, herein termed a U-bend, downward for reenforcement of the top edge and upward for the bottom edges of the panels. The lowermost panels 10 and 11 have U-bent flanges at their top edges only and the uppermost sides 24 and 25 of the plenum 19 have such U-bent flanges only at their lower edges 26 and 27. The upper edges of the upper sliding panels 28 and 29 are flanged to fasten to the bottom edges 26 and 27 of the uppermost panels 24 and 25 of plenum 19.

Figure 10:
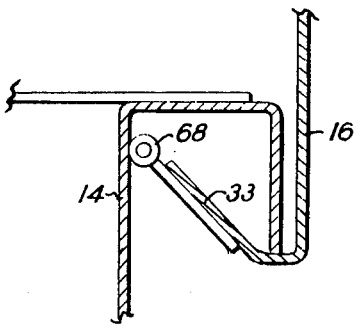
FIG. 10 is an edge seal detail in which the lower end of a panel carries a roller to bear against the outer surface of a lower panel.
Figure 11:
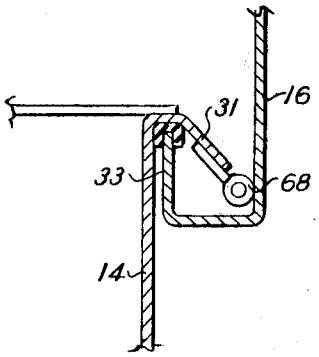
FIG. 11 is a modified panel edge seal in which an upper edge of a panel carries a roller to bear against the inner surface of an upper panel.
Figure 12:
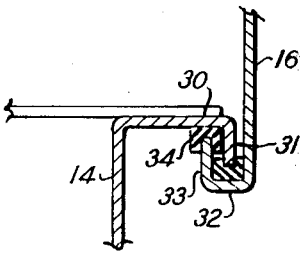
FIG. 12 is another form of modified panel edge seal showing the resilient sealing material mounted within cooperating edge flanges.

For instance, as shown in detail in FIGS. 9 and 12, a panel 14 is bent horizontally at the top 30 with a downturned flange leg 31 to form an inverted U-bend shaped channel in which may be received an upturned U-bend mating bottom channel of the next higher panel member 16, having an inwardly bent flange 32 and an upwardly bent leg at 33. As shown, the inwardly and upwardly turned lower edge 32 of the U-bent flange of the upper panel 16 mates with but is preferably smaller than the upper edge 30 of downturned channel 30 and 31 but, nevertheless, the smaller channel 32 fits into the U-bent flange 30 of the lower panel 14. These flanges are shown as being U-bent, but may be of different shapes as shown in FIGS. 10 and 11. However, they are intended to interfit sufficiently close as upper and lower separable joints to form a reenforcing channel for each panel. The flanged joints thus impart strength and rigidity to the panels, each receiving and gripping the next adjacent panel in a seal which is relatively gas tight to avoid lateral loss of air through the seal. The combined flanges forming the joint provide reenforcement for one panel section against the next, whereby the door panels do not rattle or shake or vibrate in the wind by lateral pressures of variable weather conditions. Again, these U-bends allow easy vertical removal and realignment of these flange bends by simple vertical movement of the panels. In the sense that the U-bend channels may be thus modified in shape, the term "u-bent" is used herein in a generic sense.

While the wall opening hereof is closed such as by a sliding door, usually for a garage, warehouse or factory, such opening being protected by the air screen when open, thus preventing heat exchange between the inner and outer spaces, the structures herein may be used for protecting any wall opening such as a window and the term 'closure' is intended to be used in its generic sense to refer to either.

As shown in FIG. 12, a flexible gasket 34 may be emplaced in the joint to impart a further air sealing effect. The upturned flange edge 33 of the panel 16 bears against the inner face of panel 14 in upward sliding movement. Correspondingly, the downturned flange 31 of the lower panel 14 can bear against the inner side of panel 16 as a guide so that the panel 14 in vertical movement will slide against the panel 16 with the flanged edges bearing against the surfaces for guiding movements as the door opens and closes.

Correspondingly, a lower mating joint 35 and still lower joint 36 will each grip and separate to slide a lower panel against the upper one to nest telescopically as the door closes and opens, as shown in FIGS. 2 through 6. A corresponding set of flanges 37 and 38 between adjacent edges of panels in the inner door section B operate similar to those of section A to grip or guide the inner series of panels for simultaneous closure of the inner door.

Figure 4:
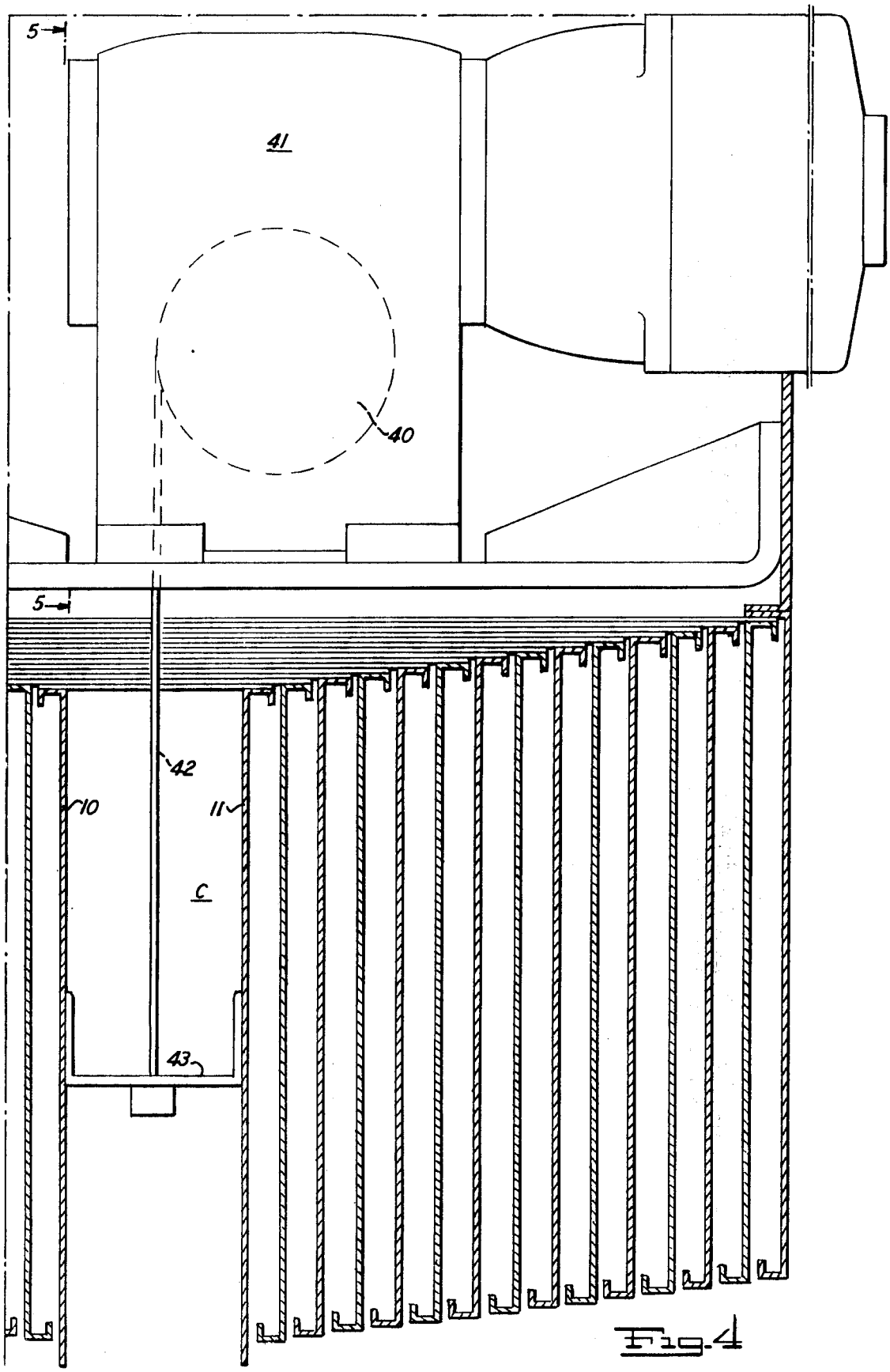
FIG. 4 is an end view of the closure in open panel nested position in section to illustrate nesting and the details of the raising and lowering means.
Figure 7:
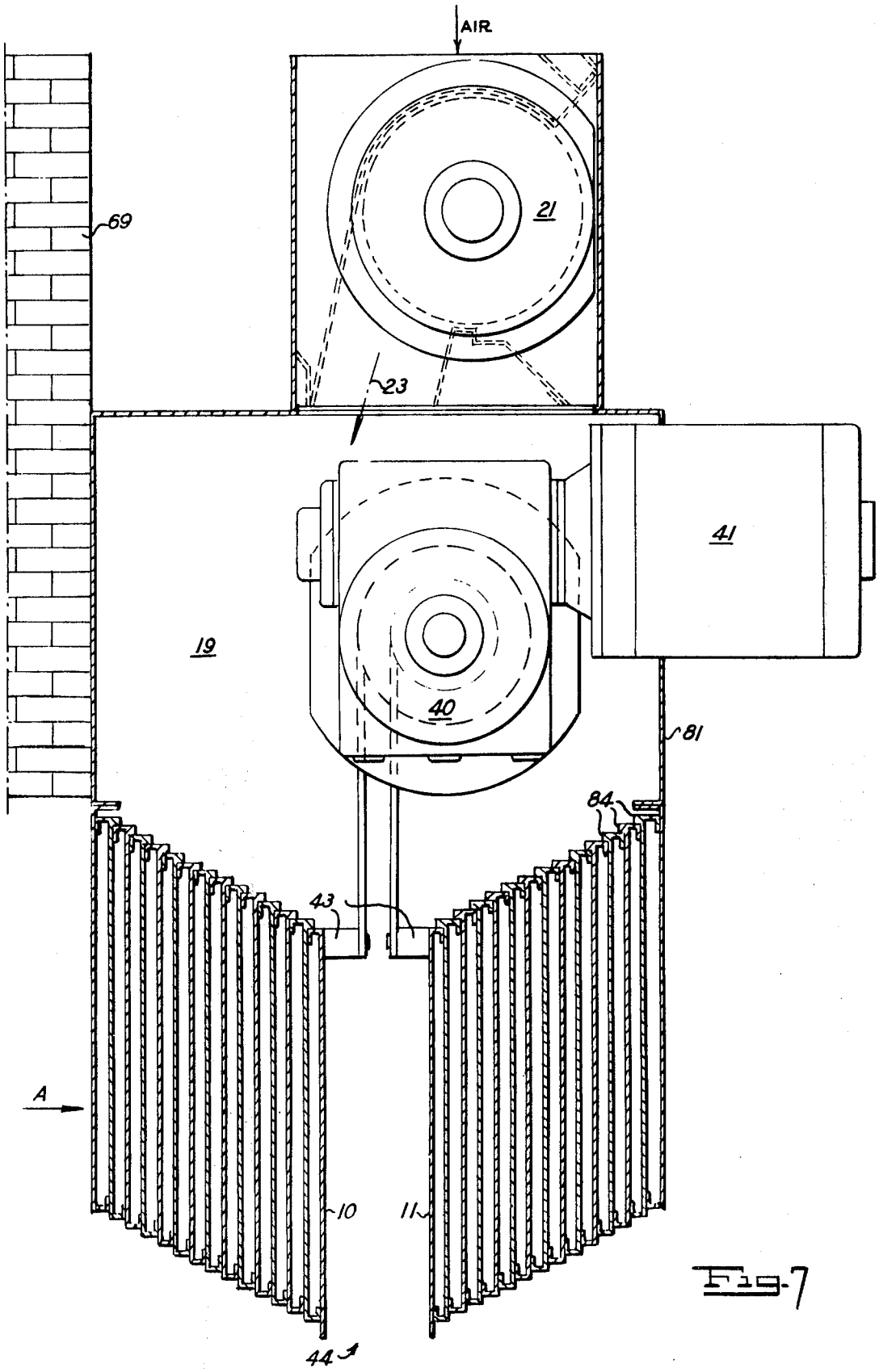
FIG. 7 is another detailed end view of the closure in open door position and in section using a top mounted tangential fan.

As shown in FIGS. 4, 5, 6 and 7, a winding drum or pulley 40 is rotatably mounted near each end of the door on a shaft 39 and is driven by a motor 41. Wire cables 42 are entrained about drums 40. The opposite ends of cables 42 pass downward through the central duct section C of the door and are fastened to each of the brackets 43 between the lowermost panels. There are usually two cables 42 near opposite ends of the door, whereby upon rotation of the winding drums 40 the series of panels, starting with the lowermost 10 and 11 of both sections are raised vertically. There may be disposed inwardly projecting stop members on each section 84 (FIG. 7) after each telescopically rises to fit adjacent to or within the next vertical section, the stop member engaging the next vertical section to raise it from its telescoped position into the succeeding vertically disposed section until all are nested in the open or partially open door position as shown in FIGS. 4, 6 and 7.

It is preferred herein as shown to fasten strap members 46 across the tops of pairs of panel members disposed at the same vertical height to fasten them together. For instance, the lowermost strap members **46*a* is welded or bolted at 50 through a flange top 36 at each side of the strap as it extends across the tops of panel members 10 and 11, fastening them together as a pair. Similarly, an upper strap 46*b* fastens a second vertical pair of panels 12 and 13 together and a next higher strap member 46*c* fastens the pair 14 and 15 panels together and a highest strap member 46 fastens the uppermost panels together. In this manner the entire series of panels of the outer and inner door sections A and B, each pair of the same corresponding height, are strapped together to rise together as a unit as the ropes or cables 42 are drawn upwardly upon the winding drums 40, lifting and lowering the lowermost sections 10 and 11** fastened at their bottoms to both sides thereof and the next succeeding section in the series as it is raised.

The lowermost section consisting of strapped-together panels 10 and 11 and usually also a nozzle 44, telescopically nests within the next higher strapped-together pair of panels 12 and 13. The panels 10 and 11 and their upper straps **46*a* bear against the corresponding straps 46*b* with the next upper section consisting of the panels 12 and 13, so that if the cable 42 is further lifted, both sets of panels, telescopically nested, move upward into the next higher pair of panels to nest within panels 14 and 15 and thence within 16 and 17, as shown in FIGS. 4, 6 and 7**, including as well as many other panels as may comprise the closure, strapped together.

Figure 8:
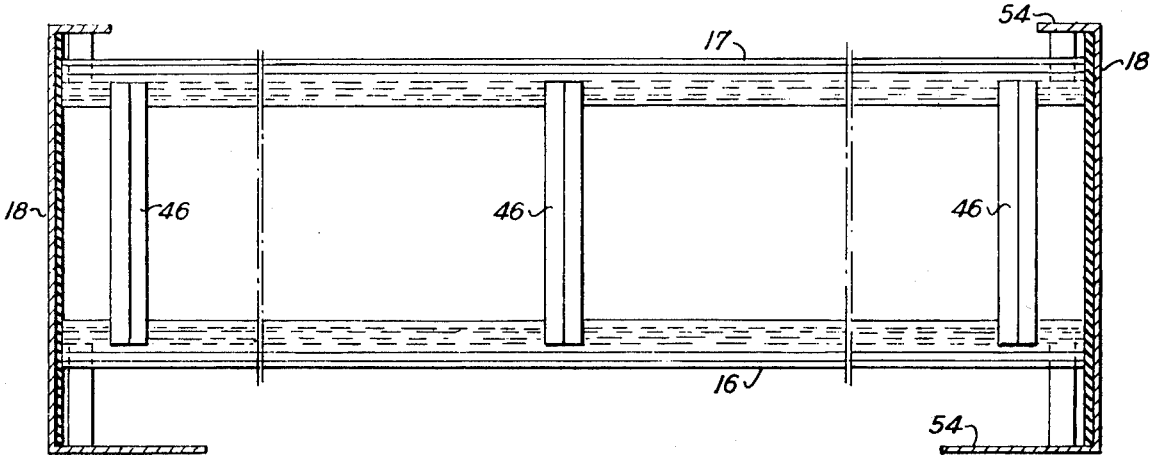
FIG. 8 is a section taken in plan along the lines 8— 8 of FIG. 2 showing corresponding panels of inner and outer sections of the closure fastened together with straps.

The ends of the closure are sealed within a channel member 18 as shown in FIGS. 2 and 8, one at each end of the closure. The channel 18 has flanges 54, each tapering at least one side from top to bottom whereby, in the closed position, the taper may correspond to the exact inner to outer dimensions of the telescopically combined sections of the closure so that the flanges 54 bear against the lowermost edges of each pair of panels to frictionally support the total series of panels wedged thereagainst by their weights at each higher level. However, it is preferred in a modification to bend a portion of the flange as at 56 inward at the level of the bottom of each panel to form a ledge or support for a panel in closed-door position. With this structure the ledge 56 and inturned portion of the flange 54 rise under and support a panel member from each side.

Figure 3:
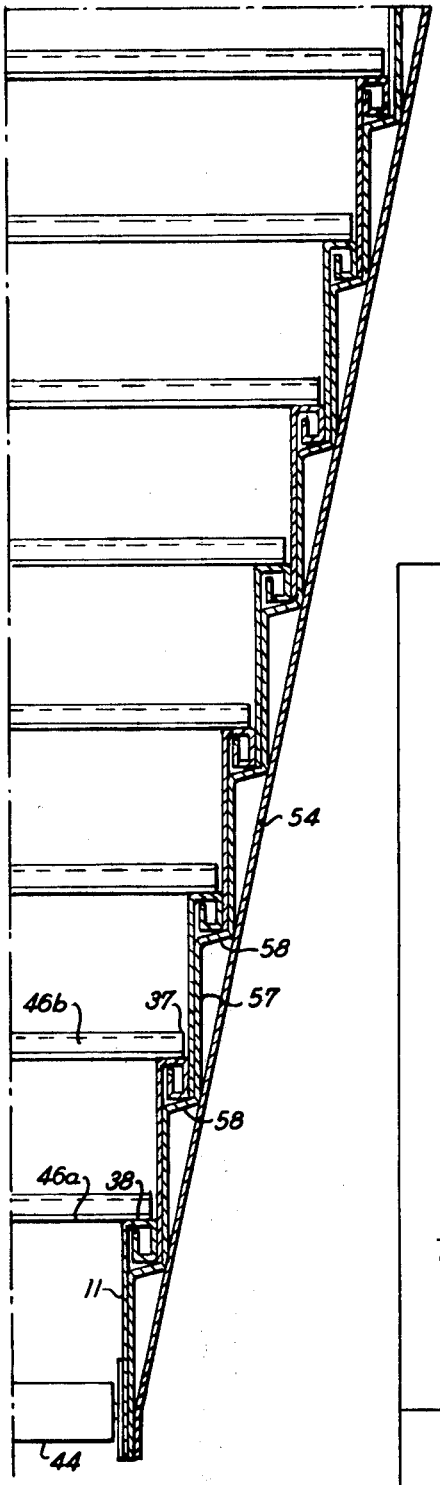
FIG. 3 is a detail of a similar end view in section of the closure in closed position, showing an alternate end sealing means.

In another modification as shown in FIG. 3, each channel 18 may have an inner support 57 supported by the flange 54 and formed as a series of steps 58 upon which each panel may rest for support in open door position.

It will be useful to line or coat the faces or webs 18 of each channel member with a sealing material such as plastic or sponge rubber or preferably polyfluoroethylene to prevent loss of air through the ends of the door and to provide sealing thereof and reduced friction upon the ends of the closure for movement while supplying efficient end sealing.

The lowermost panels 10 and 11 as shown in FIG. 4 are parallel to each other and are open at the lower end to emit the air as a sheet or curtain having parallel sides. As shown in FIGS. 2, 6 and 7, the lower panels 10 and 11 are fastened to opposite sides of a nozzle member 44 which comprises a grill formed of horizontal cross louvres 58 whereby the louvres may be adjusted laterally for modifying the downward direction of the air screen from side to side. Moreover, for further modifying the direction of flow in the doorway directions i.e., to the sides A or B as shown in FIGS. 6 and 12, an adjustably mounted deflecting shield or arm 60 may be mounted at one side of the nozzle 44 to deflect the air current inward of the closure in the direction B, as desired. Again, the arm 60 may be mounted in the opposite direction on the opposite side of the nozzle depending from the panel 11 side whereby to deflect the air current outward of the closure in the direction A.

In a still further modification, as shown in detail in FIG. 2, the lower part of the nozzle may terminate in a slotted shield in the form of a ball socked joint 62 allowing deflection through a rotatable but downwardly directed slot 64 through which passes the entire nozzle stream inward as shown by arrows 66 or outward as shown by arrows 69, rotatably.

The blower or tangential fan 21 fastened rigidly to the inner wall 69 near the wall opening 20 draws air from inside of the space 13 confined by the wall into its upper plenum 19. The blower is preferably of the tangential type as described in my patent, and produces an even air flow constant temperature across the entire plenum width in a homogeneous, non-turbulent flow downward through its outlet nozzle 23 and thence into the upper plenum 19 which evenly distributes the air across the entire upper plenum opening 19. The plenum directs the air to pass downward between the two sections A and B separated by the closure, and from which the air is emitted as a curtain through the lower outlet nozzle 44.

The closure is partially opened or raised together with the nozzle to full open to any selected intermediate position as shown in FIGS. 3, 4, 6, 7 and 15 by rotation of the drums 40 driven by a motor 41 disposed in the upper plenum 19. Thus the blower 21 passes a blast of air through its outlet 23 and down through the central passageway C of variable length, depending upon the open or partially open positions of the closure: and then downward through the outlet nozzle 44 forming an air curtain over the open portion of the door, the length of the curtain to fill the wall opening depending upon the position of the closure. In that manner a source of air at a fixed position above the door may be taken from within the building and passed downward through the door to produce an air curtain of constant air temperature and quality. The closure, per se, itself becomes easily opened by collapsing vertically, such as by telescoping into the uppermost panel level of the closure, without interferring or obstructing the central air flow channel through which the air is passed.

As shown in FIG. 6, the blower 21, preferably a tangential blower, is mounted beside the upper plenum chamber 19 so that a stream of air 23 enters under the steady pressure of the blower or fan 21. While that fan could be a conventional centrifugal blower, the use of the tangential fan has important advantages, primarily in that it provides a steady homogeneous stream of air 23 passing into the plenum 19 with a minimum of turbulence. The fan of FIG. 6 is shown as mounted beside the upper plenum 19 to flow air therein laterally. This allows the entire air curtain device to be mounted within the wall opening 29. Moreover, with that kind of fan mounting adjacent to one end of the closure, it could be made to operate horizontally with the several plenums 19 moved laterally by a servo means (not shown): and the air curtain then would be blown laterally or horizontally across the opening 20.

Figure 14:
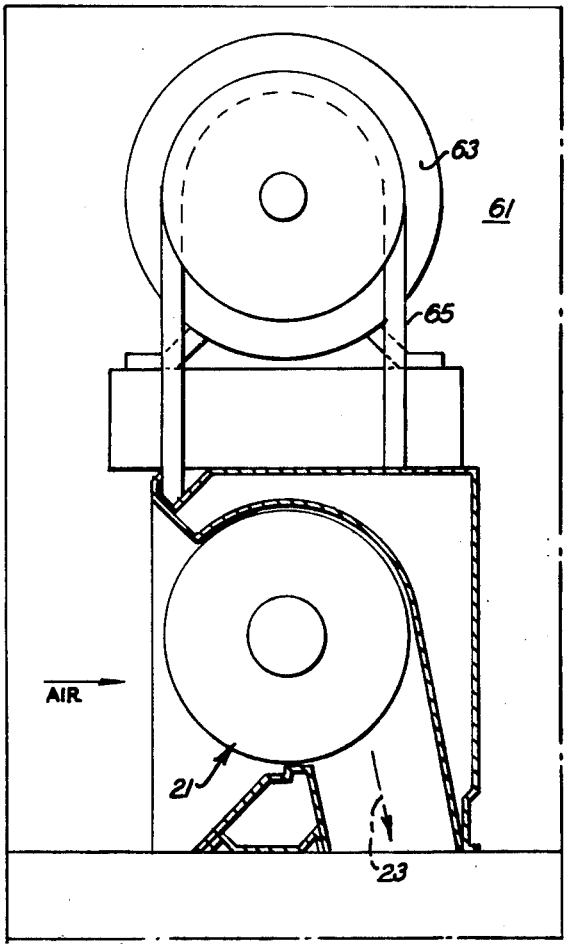
FIG. 14 is a section through the tangential fan modified for side entry of air.

In a modification shown in FIGS. 7 and 14, the blower can be mounted on top of the closure, and the entire closure is displaced inward or outward of the opening 20; that is, with the outer or inner sections A or B disposed adjacent to the wall sides 69 or 71, thus affording both the convenience of mounting of the blower on top of the plenum 19 as well as to allow mounting of a door parallel to the inner or outer walls 71 or 69 of the building.

Figure 5:
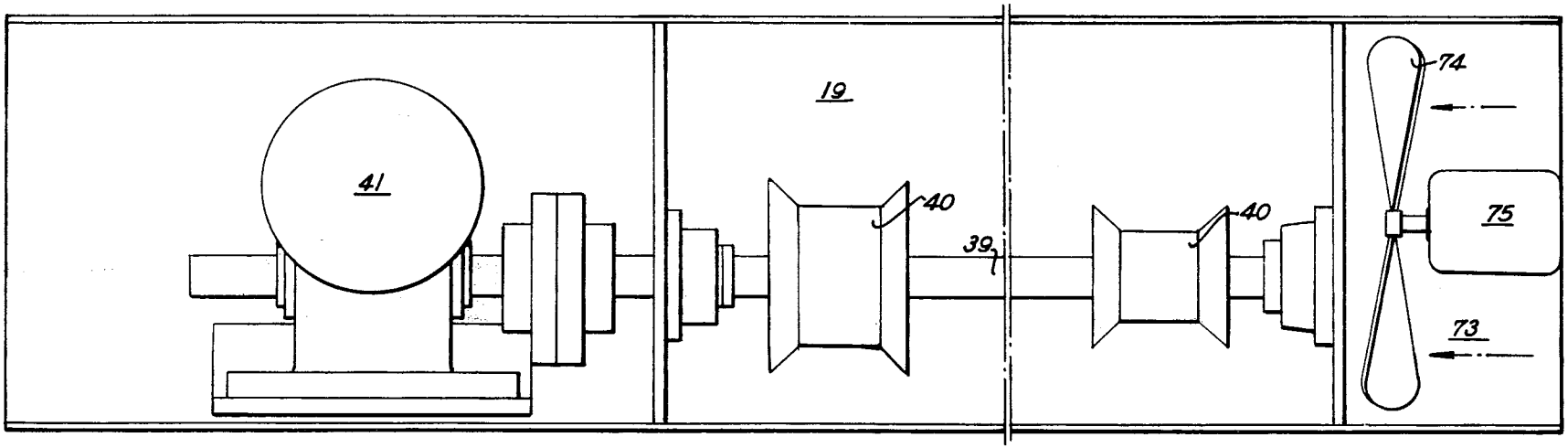
FIG. 5 is a section through the plenum chamber taken on the line 5— 5 of FIG. 4.
Figure 13:
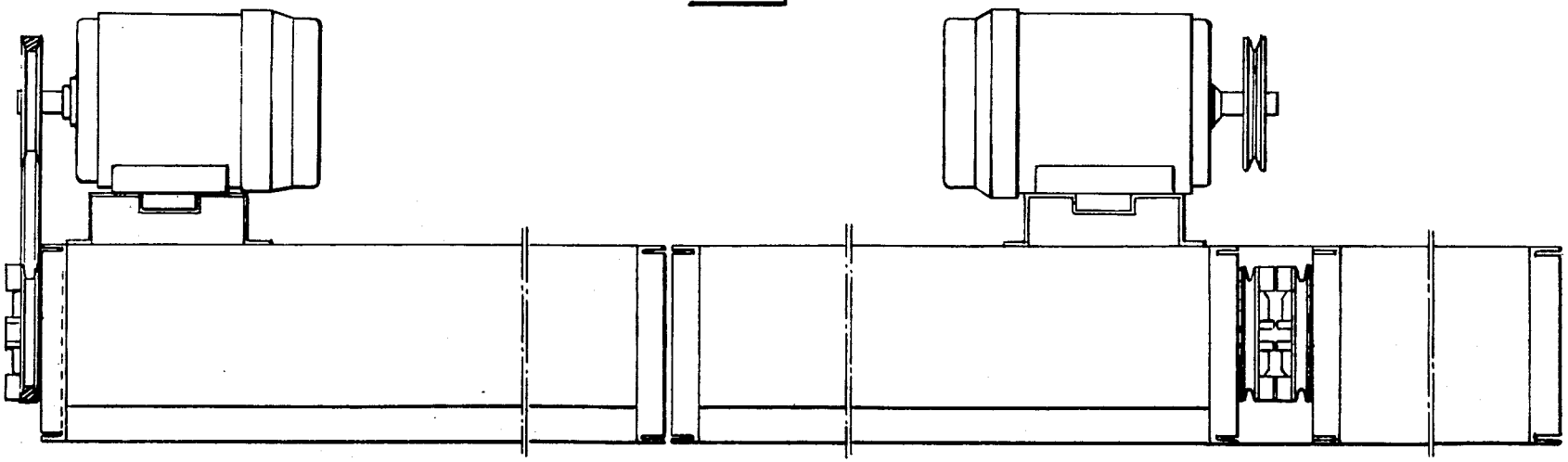
FIG. 13 is a longitudinal sectional elevation through the tangential fan.

It is possible, of course, to mount a fan or blower beside one axial end of the plenum chamber 19 to pass the air into the plenum axially thereof, as shown in FIG. 5. For this purpose a fan 74 mounted in an end 73 of the top plenum 19 is driven by a motor 75 to pass air axially therein. It is preferred either to mount the fan as shown in FIG. 7 above the plenum or when the closure is inside or outside of the opening 20, inward or outward thereof at a point near the top to pass the air stream 23 laterally into the plenum 19 as shown in FIG. 6.

It will be noted as shown in FIG. 6 that as the door closes from open position, the plenum 19 operates in the closing direction of the door and continues to increase in length as the nested panels descend and additional panels become a sectional wall portion of the partially closed door. Thus, when the closure is partially open, as shown in FIG. 6, the plenum as a series of chambers is greatly increased in length, in contrast to where the several plenum chambers comprising the panels are fully nested within the upper chamber, as shown in FIG. 7. The air within the plenum is at the constant pressure supplied by the fan 21 whereby the air emitted through the nozzle 44 or through the low straight parallel panels 10 and 11 is emitted at a constant angular or downward pressure. Thus, an air screen of relatively constant pressure in smooth laminar flow is produced being emitted from the lower nozzle at the same pressure existing within the plenum 19, despite the variation in the height of the door between open and closed position; that is, despite variation in height or size of the expandable plenum per se.

Experience has proved that if the relationship between the cross-section of the plenum A [which may vary as the door opens, as stated,] and the total outlet area of the nozzle $\Sigma a$ can be kept greater than or equal to the ratio of 3:1, or [$A/\Sigma a \geqslant 3/1$], then the variation in air velocity at the outlet nozzle can be kept to less than 10%. These can be computed by the formula for the relationship between nozzle velocity U. and wind velocity W; X = air screen distance from nozzle in feet, as follows:

$2b^{\circ}$ = nozzle width in feet $$U_o = \sqrt{\frac{X}{2b^{\circ} \times 1.68}} \times W$$

That relationship can be shown in the following example:

Given a nozzle velocity of 6000 fpm and a nozzle width of 3 inches and a closure height of 14 feet, an air screen can stop a lateral wind velocity according to the equation:

$$W = 6000 \sqrt{\frac{0.25 \times 1.68}{14}} = 6000 \times 0.5 \sqrt{\frac{12}{100}} = 300 \sqrt{12} = 600 \sqrt{3} = 1040 \text{ fpm} = 12 \text{ mph}$$

| OPENING WEIGHT OVER FLOOR IN FELT | NOZZLE VELOCITY FPM | MAXIMUM WIND WHICH CAN BE STOPPED (1 MPH = 87.5 FPM) | |
|---|---|---|---|
| 14 feet | 6000 | 1040 FPM | 11.9 MPH |
| 13 | 6000 | 1080 | 12.4 |
| 12 | 6000 | 1120 | 12.8 |
| 11 | 6000 | 1175 | 13.4 |
| 10 | 6000 | 1230 | 14.3 |
| 9 | 6000 | 1300 | 14.9 |
| 8 | 60000 | 1380 | 15.8 |

-continued

| OPENING WEIGHT OVER FLOOR IN FELT | NOZZLE VELOCITY FPM | | MAXIMUM WIND WHICH CAN BE STOPPED (1 MPH = 87.5 FPM) |
|---|---|---|---|
| 7 | 6000 | 1475 | 16.9 |

Thus, as this table shows, by closing the telescopic door from a height of 14 feet to an intermediate height of 7 feet, the lateral draft of wind pressure is kept stopped by the air screen, increasing from 11.9 mph to 16.9 mph or $$[11.9 \times \sqrt{\frac{14}{7}} = 16.91].$$

It will be seen that the air curtain protection or resistance against true draft from a lateral wind increases approximately by the square root of the distance by which the air curtain is enlarged; or, conversely, the cross section of the plenum is enlarged. Again, the enlargement of the plenum by placing the door in partial open position increases the lateral wind resistance by the square root of the velocity through the nozzle.

As shown in FIGS. 2, 3, 6, 7 and 9, each pair of panels slides vertically in the end channels 18, each panel sliding relative to each other to nest, the lower within the next higher, telescopically in a series, as the closure is opened. The panels 12, 14 and 16 as shown in FIG. 10 may each have roller members 68 mounted on the inner flange 33 to bear against the outer surface of the next lower panel 14 so that rolling movement of the inner flange 33 against the surface 14 is provided with little friction, scratching or scoring of a polished surface of the panel. For that purpose the roller 68 may be a series of longitudinally disposed rollers extending from several positions along the flange; or it may be a single roller.

As shown in FIG. 11, it may be preferable to mount the roller on the upper flange member 31 whereby the roller 68 will bear against the inner surface of the upper panel 16 as the panels 14 and 16 slide vertically relative to each other. In this manner, any possible scrathing or scoring of a panel surface is held to the interior surface of the panel. Obviously rollers 68 may be supplied to both upper and lower flanges.

As shown in FIG. 12, it may be desirable between cooperating flange elements to mount a cushioning, sealing or an insulating gasket 34 within the U-bend of the flange to engage the edge 33 of a flange to provide a desired cushioning or sealing effect of one flange element against the next. Similar sealing gaskets 34 can be supplied in the same manner to the inner bend of the opposite engaging flange 32.

Figure 15:
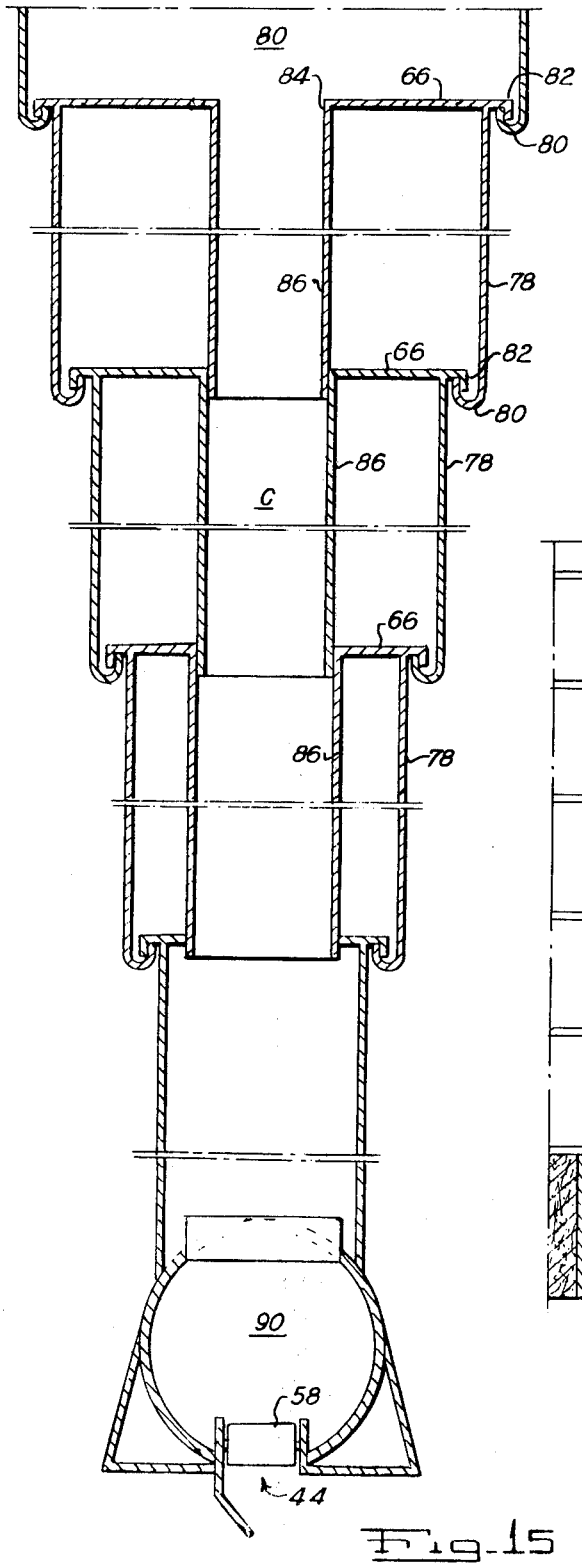
FIG. 15 is an end view showing a modification of a panel closure of U-shaped telescopically interfitted sections in which the downturned legs from the panels having internal telescoping annular ducts.

In a modification shown in FIG. 15, the combined side panels may be formed as a U-shaped section comprising a flat top portion 76 having downturned sides 78 such as shown in U.S. Pat. No. to Sims, 2,057,850. Each of these U-shaped sections are sized to telescopically interfit, the lower into the higher, so that the group of sections form a closure of telescopically interfitting sections. The upper surface top portions 66 of a section may have similar mating and sealing flanges laterally extending whereby a low edge flange 80 may extend laterally inwardly to engage and seal with an upper flange 82 welded to extend laterally from the top 66 of each U-shaped section. The upper surfaces 66 may have an annular portion 84 cut out and into which are fitted the tubular members 86. These tubular members are fitted to slide nestingly into each other from one U-shaped panel section into the next, vertically, thus to allow the interior of the section to form a series of several ducts telescopingly interfitted to conduct the air from the upper plenum 88 to a lower plenum 90 having a similar nozzle outlet 44. The telescopically fitting series of U-shaped sections as well as their internal annular ducts telescopically nest in opening and closing which continuously provide the telescopic ducts. The ducts terminate in a lower plenum 90 beneath which is fitted a nozzle outlet 44 to provide an air curtain downward, while the series of slidable tubular ducts 86 conduct the air between plenums 88 and 90 in any telescoped vertically raised position of the sections. While the tubular ducts are preferred, they may also be rectangular or otherwise shaped.

In other modifications it is possible to constrict the outer A and inner B sections to operate independently of each other, the cross strap members 46 being omitted while raising each side panel by extensions of the flanges inwardly at 84 which act as inwardly extending stops, the lowermost panel engaging the upper one by engaging the stop 85 extending inward of each panel as shown in FIG. 7. For this construction an independent cable 42 will fasten to an independent drum 40, each supported on a separate winding shaft 39 (not shown).

Moreover, as shown in FIG. 9, instead of merely flanging a top strap, according to FIGS. 10, 11 and 12, the flange may extend the entire length of the panel with or without sealing elements therein and in addition to the presence of reenforcing straps 46.

In a modified form as illustrated in FIGS. 2 and 6, some or all of the panels of the inner closure side B facing the wall enclosed space may have openings such as a grill or a manually adjustable louvre comprising adjustable slats 92 which may be set and turned by manual movement to open or closed position, the louvres extending from end to end in the surface of an inner section panel member. Thus the louvres 92 may be constantly open or manually set from closed to open positions, as desired, as in setting the slats of venetian blinds, whereby to allow a portion of the air passing down through the central section C of the closure to be diverted laterally at the height of the panel section having lateral openings. Preferably the louvres are mounted at the lowermost panel, but they may be mounted at any selected height so that side openings in any panel may be manually set to open or closed positions of the louvres as desired, at a selected intermediate height.

The louvre openings 92 may also be mounted vertically stationary in a side 81 of the uppermost plenum chamber 19 to provide a fixed upper position for lateral flow of air outward of the plenum, with the louvres opened or closed, as desired. In this manner when the door is partially open, air may flow as an air screen downward through the nozzle 44, protecting the wall opening in a vertical sheet comprising the air screen, and some air may be diverted to the lateral flow from the upper plenum by way of the open louvres, as desired.

Alternately, when the door is closed, the louvres, particularly in the lowermost level, may be desirably opened for lateral bottom panel air flow, since the air screen will be interrupted by the floor or bottom of the wall opening in the closed closure position. Nevertheless, lateral flow through the side louvres may be made available selectively at the desired height.

Figure 16:
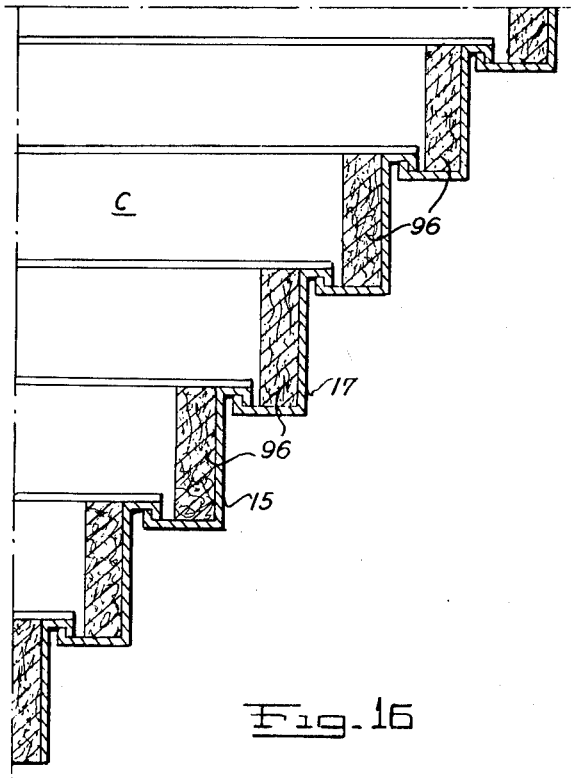
FIG. 16 is an end view of a closure similar to FIGS. 4, 6 and 7 to show inclusion of insulation against the panels.

In another modification, as shown in FIG. 16, the panels may be insulated by a sheet of insulating fiber or board 90 such as foamed plastic or matted fiber to insulate the panels, 15, 17, etc., against the transfer of heat through the usually heat-conductive metal panel. Particularly, the insulation prevents condensation of moisture carried by the central plenum air stream passing downward through the section C of the closure from depositing moisture in contact with the cold panel sections forming the closure wall. While it is common to symmetrically insulate both walls A and B, inner and outer, it may suffice in some instances to insulate only one wall whose temperature is in greatest contrast to the temperature of the air curtain air flowing downward through the central duct C.

As thus described, a pair of closure walls formed of separable panels are assembled into inner and outer sections of a wall closure, either of which may be raised independently and variously folded, as a folding garage or warehouse door is described. Preferably these closure walls are operated together as an assembly of opposite pairs of panels at the same level strapped together and inwardly spaced in the closing direction of the door as a series of telescopically nestable panels. While the separable closure sections are usually and preferably horizontally mounted between end seals such as channel irons for vertical raising and lowering, they also may be mounted from a side of a wall opening as pairs of vertically disposed panels of the closure in a wall opening, and sliding in a series between upper and lower guiding end pieces (not shown) to operate according to the same principle as the horizontal panels to fill a wall opening by sliding to and from an open to closed position as a closure from the side of the wall opening.

Preferably the nestable pairs of panels strapped together, are maintained vertically parallel to each other, depending as legs from the cross straps which confine them, the pairs of panels, into a single closure unit comprising the cross strap as a base having downturned legs. The contiguous panels carry U-bent flanges at upper and lower ends, and they further carry rollers to avoid scratching of one panel against the next in vertical sliding movement.

The open section between the panels forms a passageway for unobstructed flow of air from an upper entrance point, into which air from a blower is passed, to an opposite outlet end of the passageway between sections, which operate either by the lower two parallel panel walls as a nozzle, or into which a nozzle may be fitted for direction or deflection of the evolved air as an air stream.

Thus the construction hereof may operate merely as a door for certain periods composed of strong, preferably telescopically nestable units which serve as a strong, readily-raised and lowered closure of substantial rigidity and rugged usefulness, each panel section reenforcing, sealing against and within the next for compact storage of one section with the next; but, nevertheless, forming a variable length sealed duct between sections for conducting air interiorally either in collapsed, telescoped or extended position at any vertical height of the closure in a wall opening. Such structure allows simple and permanent mounting of the blower in a wall enclosed space upon the wall near the closure with a constant and controlled supply of interior warm or cold air evenly distributed to a plenum in the wall opening above the closure. The closure allows variable distribution from a central and readily positioned nozzle at the lower end of the closure to provide an air screen at any desired height. A lateral flow of air inward of the closure may be provided at any selected height by openings in the inner section.

Accordingly, it is intended that the above description be regarded as exemplary and not limiting except as defined in the claims appended hereto.

What is claimed is:

1. A telescopic door with spaced apart wall sections consisting of a series of equal parallel side panels, each panel being bent outward on the upper edge and inward in the opposing lower edge in such a way that each side panel easily can be caught by a superposed panel and in turn can catch the next adjoining lower panel when the door is being closed, and forming fixed connections between said side panels maintaining the same at an exact distance from each other, said outward edge bends on the panels being larger than the inward bends of the panels on their opposite edges, whereby the larger bends are supported to glide against the inner side of the adjacent superposed panels, inhibiting scratching by the inward bends against the outer side of the adjoining panels.

2. Door closure as defined in claim 1, in which the outward bends of the side panels are coated with an abrasion resistant coating material which will minimize scratching against the inside of the adjoining panels.

3. Door as defined in claim 1, having a sealing gasket in the hollows of each bend to reduce leakage of air out at the ends of each section.

4. A door closure comprising parallel spaced apart inner and outer walls enclosing an open central air space, each wall being formed of a vertical tier of parallel horizontal panels separably secured edge to edge to be telescopically nestable, one beside the next in an upper plenum chamber, means for raising each wall section for telescopic storage of separated panels within said plenum and lowering as a door closure edge to edge assembly of said panels into parallel walls while maintaining said open central air space.

5. The door closure as defined in claim 4 wherein said panels are assembled to telescope inward in the closing direction of the door, and extend horizontally from side to side to correspond to the door opening, side frames in the door opening engaging the opposite ends of said panels and forming channels tapering from top to bottom as a guide and support for said panels of both closure walls.

6. The door closure as defined in claim 4 wherein parallel panels in each of the separated walls at the same height are fastened together without substantially impeding air passage therebetween, whereby the paired panels are raised and lowered telescopically in opening and closing of the door.

7. The door closure as defined in claim 4 wherein at least one panel has as a group of louvers therein allowing lateral air flow from the central air passage through a side section.

8. Door as defined in claim 4, wherein each side frame is coated with a sealing coating to reduce friction and air leakage at the door ends.

9. Door closure as defined in claim 4, wherein at least the inner surface of the panels legs at one side of said door is covered with a heat insulating covering.

* * * * *